United States Patent [19]

Werner et al.

[11] 4,441,214

[45] Apr. 10, 1984

[54] PROTECTIVE HEAD SHIELD

[75] Inventors: Linda B. Werner; William A. Werner, both of Salem, Oreg.

[73] Assignee: Custom Stamping Mfg. Co., Portland, Oreg.

[21] Appl. No.: 425,560

[22] Filed: Sep. 28, 1982

[51] Int. Cl.[3] ..... A42B 1/18

[52] U.S. Cl. ..... 2/174; 132/9

[58] Field of Search ..... 2/174; 132/9

[56] References Cited

U.S. PATENT DOCUMENTS 2,987,730 6/1961 Walker ..... 2/174

4,289,150 9/1981 Kimball ..... 132/9

*Primary Examiner*—Doris L. Troutman

*Attorney, Agent, or Firm*—Hubbard & Stetina

[57] ABSTRACT

The present invention is an article used in the application of liquid to the hair of an individual during a beauty treatment. The article includes at least one single ply of absorbent material shirred, or puckered, and coupled to an elastic strip so as to expand. A fastener is provided for securing the absorbent material snugly around the head of the individual. Further, a flexible material is coupled to the absorbent material and extends therefrom to enclose the hair of the individual. During application of the liquid to the hair, the absorbent material prevents excess liquid from dripping on facial regions and clothing. Upon completion of the application, the flexible material can be extended and fastened so as to completely enclose the hair. Thus, annoying fumes and additional liquid are prevented from escaping the enclosure.

1 Claim, 6 Drawing Figures

PROTECTIVE HEAD SHIELD

BACKGROUND OF THE INVENTION

This invention relates generally to beauty products and more specifically, to a protective head shield for absorbing excess liquids and preventing the liquids from dripping from hair during application of various beauty treatments.

Beauty treatment of hair normally entails the application of varying amounts and kinds of liquids to the hair of an individual having the treatment. Often, as with a "permanent treatment", the liquid which is applied to the hair subjects the individual to discomfort caused by odor and excessive amounts of liquid dripping from the hair onto the facial area and clothing. Further, the liquid may be harmful if allowed to contact eyes, ears, or other sensitive areas. As a result, the individual must often bathe to remove the liquid from the body and/or must change from wet and soiled clothing into a dry set of clothing.

Beauticians attempt to solve these problems by applying cotton balls around the curlers which are positioned in the hair of the individual. The cotton balls quickly become saturated and heavy, causing them to fall from the curlers and demanding constant replacement and attention by the beautician. In addition, numerous towels are generally placed over the individual's face, shoulders and lap. However, the towels also become wet from the constant dripping of the liquid from the hair and the continuous falling of the saturated cotton balls. As a result, the towels must be continually replaced. The various treatments given to the individual by a beautician often times last for several hours. As a result, the individual having the beauty treatment must be subjected to and endure the discomfort of having wet and sometimes odorous towels placed over the facial regions, shoulders, and lap.

Apart from the discomfort to the individual, a major disadvantage of using towels in an attempt to keep the individual as dry and comfortable as possible is the cost incurred for cleaning and drying the multitude of towels soiled over a short period of time. In addition, many individuals who perform home treatments of hair without the aid of a beautician do not have the required supply of towels to successfully keep the subject of the beauty treatment dry.

There exists a need to provide an effective and cost efficient means for preventing the various liquids applied to the hair of an individual during a beauty treatment from dripping onto facial areas and clothing.

SUMMARY OF THE INVENTION

The present invention provides an effective alternative to previous means for preventing liquid from dripping onto the various portions of an individual during the application of a beauty treatment to the hair. The invention includes a comfortable and efficient means for absorbing liquid which would otherwise have to be uneffectively absorbed by the constant replacement of numerous towels positioned over the various exposed portions of the body and clothing of the individual. Further, the present invention provides a means for completely enclosing the hair of the individual after application of the treatment, so as to prevent fumes of the liquid from escaping and additionally preventing excess liquid from dripping from the hair.

Other features and advantages of the present invention will become apparent from the following drawings and description, in which:

DESCRIPTION OF A PREFERRED EMBODIMENT

Figure 1:
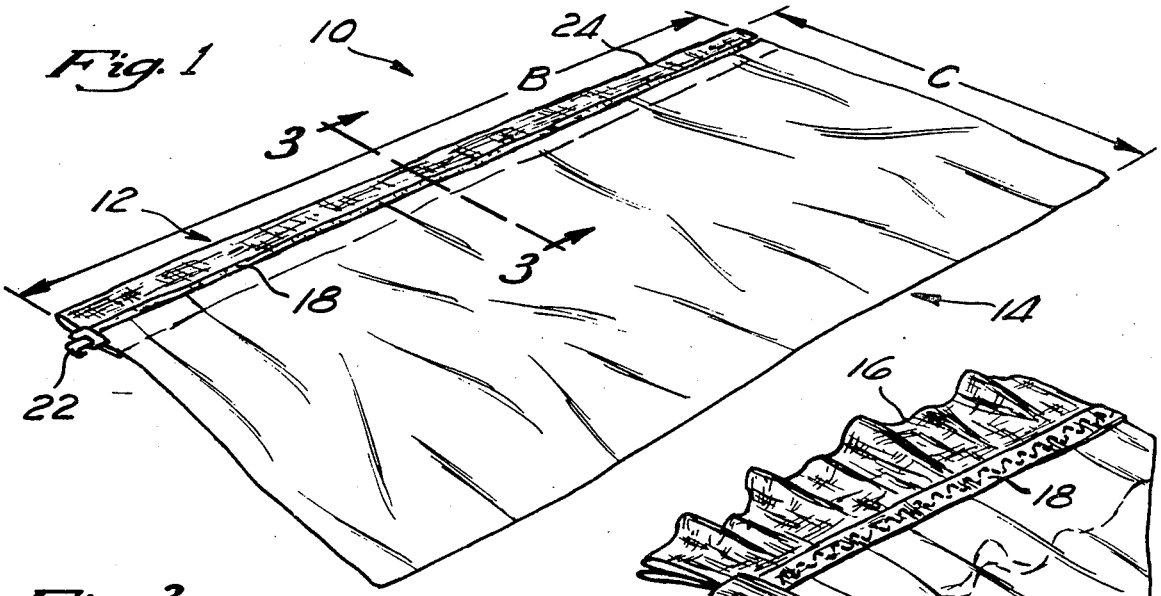
FIG. 1 is a planar view of the head shield invention stretched out prior to any sewing.

Referring to FIG. 1, an article 10 is shown for use in the application of liquid to the hair of an individual having a beauty treatment. The article 10 comprises means 12 for absorbing the liquid during and after application of the treatment, and a means 14 for enclosing the hair of the individual after the treatment has been applied. The absorbing means can be made of any absorbent material. However, as shown more clearly in FIGS. 2 and 3, a multiple ply absorbent fabric 16 proves most effective. Also shown in FIGS. 2 and 3, the fabric 16 is puckered, or shirred, and sewn or otherwise coupled to an elastic strip 18 so as to allow the absorbing means 12 to expand and then contract to fit snugly around the head of the individual. Specifically, the absorbent fabric 16 shown in the figures is four plies thick and has a width A of 2 to 3 inches. When spread out, as shown in FIG. 1 before any sewing, the absorbent fabric has a length B of between 5 to 6 feet, as does the sheet 20. The fabric is longer than the fully stretched elastic such that it is puckered even when the elastic is fully stretched. Preferably the stretched elastic is about half that of the extended fabric, or about 2.5 to 3 feet. The related elastic serves to further bunches of the absorbent fabric 16 to approximately one-third of the length B.

Figure 2:
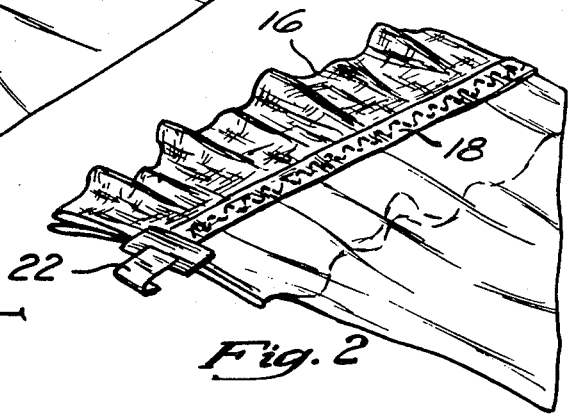
FIG. 2 is an enlarged view of a first end of the shield of FIG. 1.

Thus before sewing, the fabric and the sheet 20 are bunched and the elastic strip 18 is sewn in a zig-zag manner, as depicted clearly in FIG. 2, to the enclosing means 14 and to the approximate center of the absorbent fabric 16. Thus, a length between 0.75 to 1 inch of the absorbent fabric 16 extends below the elastic strip 18 to absorb any liquid which may escape between the elastic strip and the individual's head. Shown in FIGS. 1 and 2 is a fastener 22 to securely keep the absorbing means 12 positioned snugly around the head of the individual. The fastener 22 can be, for example, a common bandage clip which is fastened to the opposite half 24 of the fabric 16 after the absorbing means 12 is fitted to the head of the individual.

Figure 3:
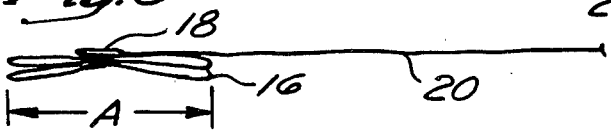
FIG. 3 is a cross-sectional view taken along the line 3—3 of FIG. 1.

The means 14 for enclosing the hair of the individual after the treatment has been applied can be made of any light weight, flexible material. A light weight plastic sheet 20 is shown in the drawings. For best results, the sheet 20 should be as substantially non-permeable as possible. Preferably, the sheet 20 should have a thickness of between 1 and 3 mils. Optionally, a heavier gauge sheet 20 could be incorporated to allow the article 10 to be reused. FIGS. 1, 2 and 3 show one side of the plastic sheet 20 puckered, or shirred, and sewn to the elastic strip 18. Thus, the plastic sheet 20 expands and contracts simultaneously with the absorbent fabric 16. Specifically, the sheet 20 has a length compatible with that of the absorbent fabric 16, namely between 5 to 6 feet. The sheet 20 extends from the fabric to a width C of betwen 1 to 1.5 feet.

Figure 4:
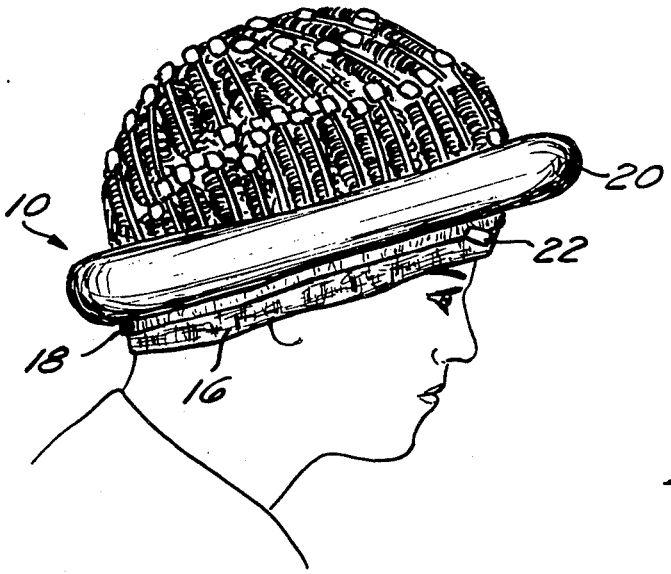
FIG. 4 depicts the shield after being positioned upon the head of an individual during application of a hair treatment.

Referring to FIG. 4, the article 10 is shown positioned around the head of an individual having a treatment applied to the hair. The absorbing means 12 is positioned below the hair line of the individual and across the forehead and the back of the neck. The fabric 16, elastic strip 18, and plastic sheet 20 are expanded to fit snugly around the head of the individual. The fastener 22 is then attached somewhere along the opposite end 24 of the fabric 16. The flexible plastic sheet 20 is folded down to allow for easy access to the hair of the individual during application of the treatment.

Figure 5:
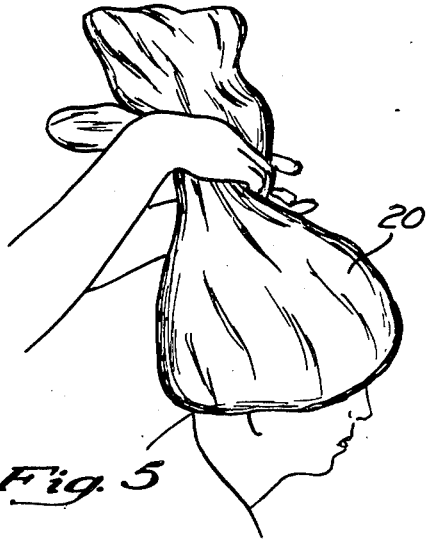
FIG. 5 depicts the shield being gathered to enclose the hair of the individual after application of the hair treatment.
Figure 6:
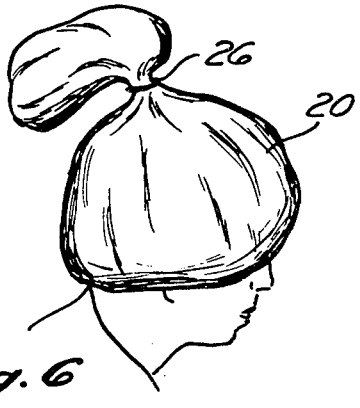
FIG. 6 depicts the shield completely enclosing the hair of the individual.

FIGS. 5 and 6 depict the article 10 with the plastic sheet 20 being unfolded to enclose the hair of the individual after the treatment has been applied. The side of the flexible plastic sheet 20 which is not coupled to the absorbing means 12 is gathered atop the head as shown in FIG. 5. A means for securing the unattached end of the plastic sheet 26 is provided so as to ensure an enclosure in which to retain fumes from the liquid, in addition to prevent any liquid not absorbed by the absorbing means 12 from dripping from the hair.

The article 10, as shown in FIGS. 4 and 6, prevents liquid from dripping from wet hair both during and after application of the beauty treatments. The absorbing fabric 16 prevents often irritating liquids from entering sensitive areas such as the ears and eyes. The flexible enclosing material 20 prevents the odors of the various treatments from being inhaled for any period greater than that necessary to actually apply the treatment to the hair. As a result, the person having the treatment applied is much more comfortable than in the past, and the beautician can greatly reduce the need for and cost of cleaning numerous towels.

What is claimed is:

1. A head shield for protection of the face and clothing during application of hair treatment liquid comprising;

a multiple-ply strip of moisture absorbent fabric having an extended length substantially greater than the distance around the head of the user;

a flexible non-permeable sheet having one edge thereof longer than the distance around the users head but substantially shorter than the extended length of the absorbent fabric;

an elastic band expansible to substantially the length of the aforesaid one edge of said non-permeable sheet;

means securing the absorbent fabric and the elastic band to said non-permeable sheet along said one edge thereof to form along said one edge a highly puckered expansible band of said absorbent fabric, said one edge of said non-permeable sheet being normally in puckered configuration and being expansible by stretching the elastic strip secured thereto to extend around the head of the user; and means for securing the respective ends of said one edge together thereby fixing the puckered absorbent fabric around and against the user's head and permitting the non-permeable sheet to drape down over the face and clothing of the user or to be wrapped upwardly about the hair of the user, the puckered absorbent fabric around and against the user's head effectively absorbing excess hair treating liquid during use.

* * * * *